United States Patent [19]

Nobutoki et al.

[11] Patent Number: 4,688,010

[45] Date of Patent: Aug. 18, 1987

[54] ELECTROMAGNETIC RELAY

[75] Inventors: Kazuhiro Nobutoki; Kenji Ono, both of Matsusaka; Keiji Okahashi, Ise; Sueyoshi Matsumura, Mie, all of Japan

[73] Assignee: Matsushita Electric Works, Ltd., Japan

[21] Appl. No.: 800,393

[22] Filed: Nov. 21, 1985

[30] Foreign Application Priority Data

Dec. 22, 1984 [JP] Japan ..... 59-271529
Dec. 24, 1984 [JP] Japan ..... 59-278585

[51] Int. Cl.[4] ..... H01H 67/02

[52] U.S. Cl. ..... 335/128; 335/79; 335/81; 335/85; 335/125; 335/181; 335/202

[58] Field of Search ..... 335/79–81, 335/84–85, 121, 125, 128–129, 132–135, 181, 184, 202–203, 276, 296, 304

[56] References Cited

U.S. PATENT DOCUMENTS

| | | | |
|---|---|---|---|
| 2,951,134 | 8/1960 | Lazich | 335/85 |
| 2,965,954 | 12/1960 | Baker | 335/120 |
| 3,377,519 | 4/1968 | Stong | 335/202 |
| 3,524,153 | 8/1970 | Little | 335/202 |
| 3,544,930 | 12/1970 | Sauer | 335/202 X |
| 3,553,612 | 1/1971 | Zimmer | 335/276 |
| 3,553,613 | 1/1971 | Turnbull et al. | 335/132 |
| 3,668,578 | 6/1972 | Schroeder | 335/202 |
| 3,824,511 | 7/1974 | Aidn et al. | 335/202 |
| 4,101,856 | 7/1978 | Durr | 335/135 |
| 4,136,321 | 1/1979 | Smith | 335/202 X |
| 4,215,329 | 7/1980 | Kobler | 335/79 X |
| 4,227,162 | 10/1980 | Fujita et al. | 335/135 X |
| 4,302,742 | 11/1981 | Schedele | 335/202 |
| 4,339,735 | 7/1982 | Ono et al. | 335/119 |
| 4,340,876 | 7/1982 | Dammert et al. | 335/203 X |
| 4,509,026 | 4/1985 | Matsushita | 335/85 |
| 4,571,566 | 2/1986 | Saur | 335/81 X |
| 4,587,501 | 5/1986 | Agatahama et al. | 335/202 X |
| 4,602,230 | 7/1986 | Schedele | 335/81 X |

FOREIGN PATENT DOCUMENTS

| | | | |
|---|---|---|---|
| 2407057 | 8/1975 | Fed. Rep. of Germany | 335/131 |

*Primary Examiner*—Arthur T. Grimley
*Assistant Examiner*—Jane K. Lau
*Attorney, Agent, or Firm*—Stevens, Davis, Miller & Mosher

[57] ABSTRACT

An electromagnetic relay has a casing of electrically insulative material which is divided by an insulating partition into a coil space for receiving an electromagnet and a switching space for receiving a contact assembly. An armature is magnetically coupled to the electromagnet and is operatively connected to the contact assembly for switching contact operation thereof in response to energization of the electromagnet. The partition extends along the entire length of the electromagnet without leaving any communication path between the coil space and the switching space, such that the electromagnet in the coil space can be insulatively separated from the contact assembly in the switching space within the length of the electromagnet.

7 Claims, 12 Drawing Figures

ELECTROMAGNETIC RELAY

BACKGROUND OF THE INVENTION

1. Field of the Invention

The present invention relates to an electromagnetic relay, and more particularly to an electromagnetic relay including a mount base provided with an insulation partition for separating an electromagnet from a contact assembly.

2. Description of the Prior Art

Electromagnetic relays, particularly relays requiring a high contact rating within a small-sized casing are known to have a partition wall dividing the interior of a relay casing into two spaces, one for mounting an electromagnet and the other for a contact assembly. The relay construction having the above partition for separating the electromagnet from the contact assembly becomes more essential for designing a miniature relay in which components are dense-packed with a maximum insulation resistance between the electromagnet and the contact assembly. Prior relays having the above partition are disclosed, for example, in U.S. Pat. Nos. 4,101,856, 4,302,742, and 4,339,735, in all of which the partition extends along the length of the electromagnet for separation thereof from the contact assembly. However, the partition employed in each prior art relay must have a slot or opening within its length for passing therethrough a card or like actuating member which operatively connects the electromagnet to the contact assembly in order to actuate the switching operation of the contact assembly in response to the energization of the electromagnet. Unfortunately, due to the slot or opening formed in the partition, the partition fails to achieve complete insulation between the contact assembly and the electromagnet within the entire length of the electromagnet, and therefore the slot or opening is likely to form a shortcut leakage path between the electromagnet and the contact assembly through which a possible arcing originating from the contact assembly may extend to and damage the electromagnet. With the partition of the prior relays, therefore, the electrical insulation is interrupted at a portion of the partition so as to considerably reduce the effectiveness of the partition and only provide unsatisfactory insulation, which is a hindrance to designing a miniature relay having a high contact rating in which magnetic and electric components are required to be dense-packed at a maximum insulation resistance.

SUMMARY OF THE INVENTION

The above problem is eliminated in the present invention which has a unique and novel constructional feature. An electromagnetic relay according to the present invention comprises a mount base of electrically insulative material having a coil space for receiving an electromagnet and a switching space for receiving a contact assembly. An armature is magnetically coupled to said electromagnet and is operatively connected to said movable contact for making the switching contact operation thereof in response to the energization of the electromagnet. Said mount base is formed with an insulating partition by which the mount base is divided into said coil space and the switching space. The partition extends along the entire length of the electromagnet without leaving therebetween any communicating path within the length of the electromagnet in order to completely separate the coil space from the switching space.

With this arrangement, the whole length of the electromagnet can be successfully insulated from the contact assembly by the partition free from a slot or any other opening so as to assure satisfactory insulation therebetween, eliminating the formation of any shortcut leakage path extending through the partition. This is advantageous particularly for a miniature relay having a high contact rating where no extra space is available for insulation purpose.

Accordingly, it is a primary object of the present invention to provide an electromagnetic relay which is capable of achieving effective and satisfactory insulation by the partition between the electromagnet and the contact assembly, and which is suitable for the miniaturization of the relay while assuring a maximum insulation resistance therebetween.

In preferred embodiments of the present invention, there is disclosed an advantageous construction feature effective for attaining the above insulation by the partition. The mount base of the relay is in the form of a casing having a generally rectangular bottom wall, opposed side walls extending upwardly from the lateral sides thereof, and an end wall extending upwardly from one longitudinal end of the bottom wall and joining said side wall at its lateral ends. The partition extends from said end wall in generally parallel relation to the bottom wall between the opposed side wall so as to define the coil space thereabove and the switching space therebelow. Said partition extends along the entire length of the electromagnet mounted in the coil space with its longitudinal axis lying horizontally so as to completely separate the coil space from the switching space without leaving any communication path therebetween within the length of the electromagnet. The partition terminates at an edge which is recessed with respect to the longitudinal ends of the casing opposite to the end wall so as to define thereat a recess which is spaced horizontally outwardly of the longitudinal end of the electromagnet and through which the coil space is only communicated with switching space for operative connection between the electromagnet and the contact assembly by the armature. The armature is disposed adjacent the one longitudinal end of the electromagnet to be magnetically coupled thereto and is provided with a card of electrically insulative material which passes around the open end of the partition or through said recess into the switching space for connection with the contact assembly. With this arrangement, the coil space is communicated with the switching space only at the open end of the partition which is spaced outwardly from the longitudinal end of the electromagnet such that the entire length of the electromagnet is kept completely insulated by the partition from the contact assembly, while allowing the armature to extend across the coil space and switching space for establishing the operative connection between the electromagnet and the contact assembly. Further, the contact assembly has its switching contact portion located in proximity to the end wall or deep inside of the switching space so that it spaced at a maximum distance from the open end of the partition or the recess, which adds the increased insulation effect.

The armature is preferably formed on its lateral side with skirts of electrically insulative material which extend toward the side walls and are in overlapping relation with cooperative flaps extending inwardly from the side walls so as to substantially close the recess for separation of the coil space from the switching space also at the open end of the partition. In other words, the recess, which is inevitable for connection by the armature between the electromagnet and the contact assembly, can be prevented from forming a substantial leakage path therebetween. This is most effective when the contact assembly is mounted with its electrical conductive portion exposed adjacent the recess.

It is therefore another object of the present invention to provide an electromagnetic relay in which the armature can be successfully incorporated without reducing the insulation effect between the coil space and the switching space.

Also in the preferred embodiment, the relay casing is formed in at least one side wall below the partition with a port through which the contact switching portion of the contact assembly is accessible from the exterior. Thus, the contact switching portion can be viewed for checking purpose in an assembled condition of the relay and can be easily adjusted in its contact gap by manipulating a suitable tool insertable through the port, which is therefore a further object of the present invention.

The contact assembly in one of the embodiments includes two sets of contact units each comprising a movable contact actuated by the armature and at least one fixed contact. These sets of contact units have their contact switching portions spaced from each other and separated by a separator depending from said partition, whereby effectively insulating the contact switching portions of the two sets of contact units.

It is therefore a still further object of the present invention to provide an electromagnetic relay in which two sets of contact units are effectively insulated from each other.

The electromagnet employed in the present invention comprises a U-shaped yoke having a pair of opposed legs connected by a web, a core extending from said web in parallel relation with the yoke legs, a winding wound around the core, and at least one bridge member which extends across the free ends of the yoke legs for rigid connection therebetween. Thus, the yoke is reinforced to have good dimension stability well resisting against shocks which may be applied thereto during the assembly of the relay, ensuring consistent magnetic characteristics.

It is therefore a further object of the present invention to provide an electromagnetic relay in which the electromagnet is reinforced to have good dimension stability.

The present invention further discloses unique and useful construction features of the electromagnet particularly suitable for achieving a monostable or bistable switching characteristic in cooperation with the armature. The armature includes a pair of pole plates spaced along a direction perpendicular to the plane of the yoke legs and magnetically polarized to the opposite polarity by a permanent magnet interposed therebetween. In one version for the monostable operation, the single bridging member connecting the free ends of the yoke legs is made of magnetic material to serve as a pole member of opposite polarity to said core. The bridge member is spaced from the free end of the core in a direction perpendicular to the plane of the yoke legs so as to define between the core and the bridge member a gap into which one of the pole plates of the armature extends for magnetically coupling of the armature to the electromagnet. Consequently, the above bridge member acts to attract the one pole plate of the armature upon deenergization of the electromagnet and hold it in this stable position until the electromagnet is again energized.

In the other version for the bistable operation, a pair of like bridge members are introduced to connect the free ends of the yoke legs and to serve as respective pole members of opposite polarity to the core. The bridge members are spaced from each other in a direction perpendicular to the plane of the yoke legs with the free end of the core interposed therebetween. Said armature is magnetically coupled to the electromagnet with each of the pole plates extending between each of the bridge members and the core such that it has a two stable positions where each of pole plate is attracted to the adjacent bridge member upon deenergization of the electromagnet. Also in this respect, the bridge members act to attract the pole plates of the armature upon deenergization of the electromagnet, giving the bistable switching characteristic to the relay by better utilization of the bridge members introduced to give the dimension stability to the yoke of the electromagnet.

It is therefore a further object of the present invention to provide an electromagnetic relay which is made to have a monostable or bistable switching characteristic by better utilization of one or two bridge members connecting the free ends of the yoke legs.

These and other objects and advantages of the present invention will become more apparent from the following description of the preferred embodiments when taken in conjunction with the attached drawings.

DESCRIPTION OF THE PREFERRED EMBODIMENTS

Figure 1:
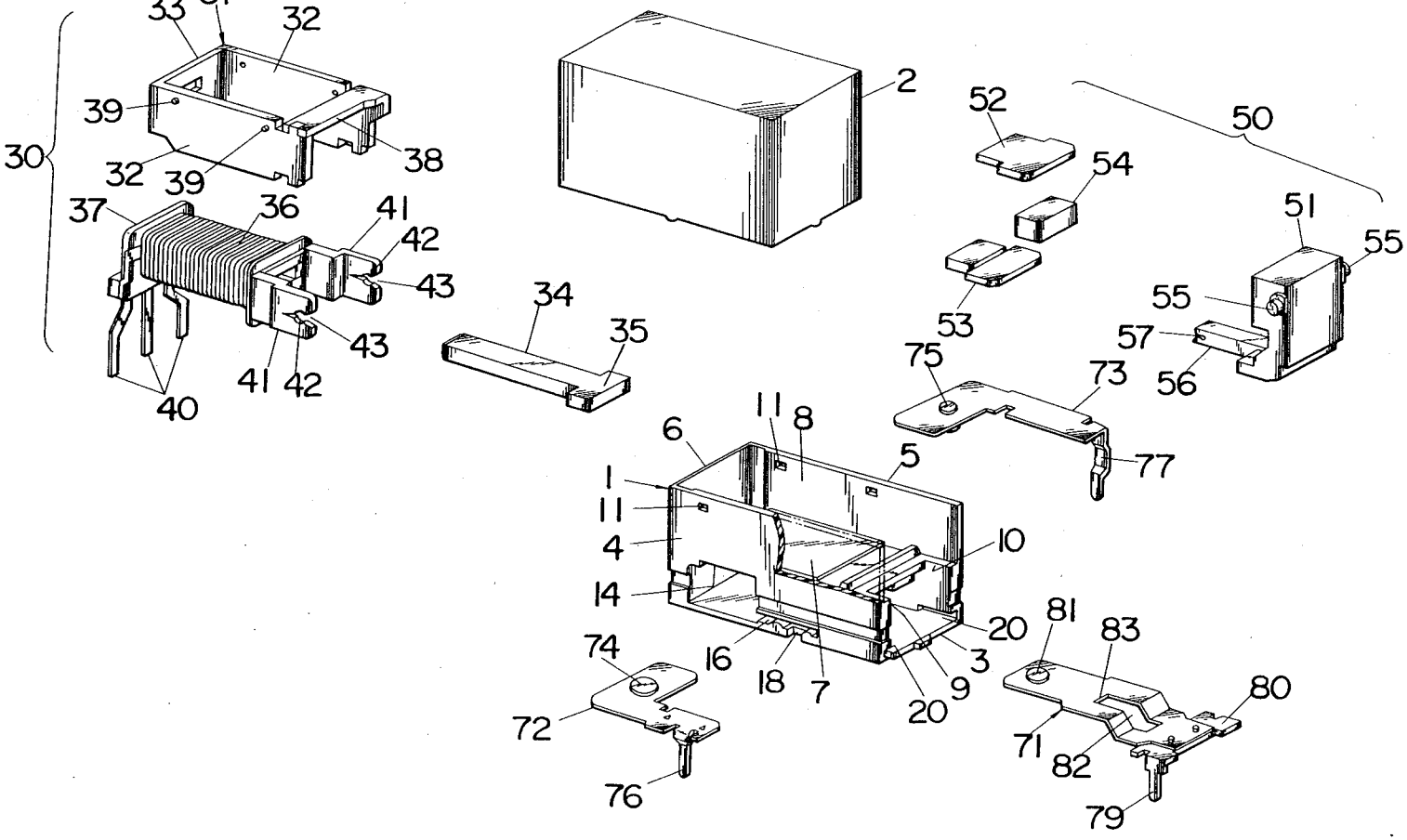
FIG. 1 is an exploded perspective view of an electromagnetic relay in accordance with a first embodiment of the present invention.
Figure 2:
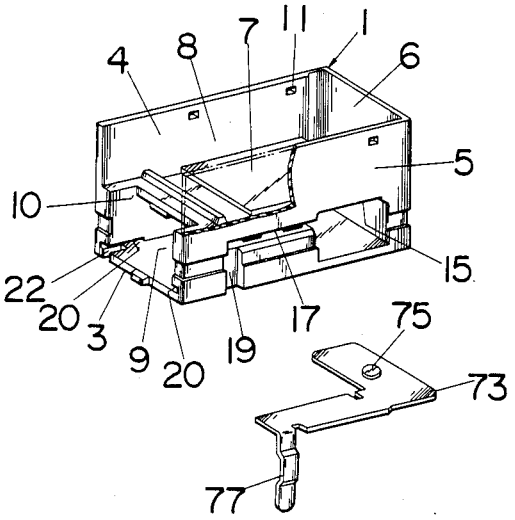
FIG. 2 is an exploded perspective view, as viewed in a different direction and shown with a majority of parts being removed, of the above relay.

Referring now to FIGS. 1 to 4, there is shown an electromagnetic relay in accordance with a first embodiment of the present invention. The relay comprises a mount base 1 for mounting an electromagnet 30, and armature 50, and a contact assembly 70. The mount base 1 is made of electrically insulative material such as molded plastics to be in the form of a casing opened at its top and one longitudinal end face. A shield cover 2 of like insulative material fits snugly over the mount base or casing 1 to close the top and one end face thereof. The casing 1 has a rectangular bottom wall 3, a pair of opposite side walls 4 and 5 extending upwardly from the lateral sides of the bottom wall 3, and an end wall 6 extending upwardly from the longitudinal end of the bottom wall 3 and joining said side walls 4 and 5 at its lateral ends. A partition 7 integrally extends from the end wall 6 between the opposed side walls 4 and 5 in parallel relation with the bottom wall 3 so as to divide the interior of casing 1 into a coil space 8 for mounting said electromagnet 30 and a switching space 9 for said contact assembly 70. Said partition 7 extends a distance greater than the length of the electromagnet 30 and terminate at an edge which is recessed with respect to the longitudinal open end of the casing 1 to leave thereat a recess 10 through which said coil space 8 is communicated with said switching space 9.

Figure 3:
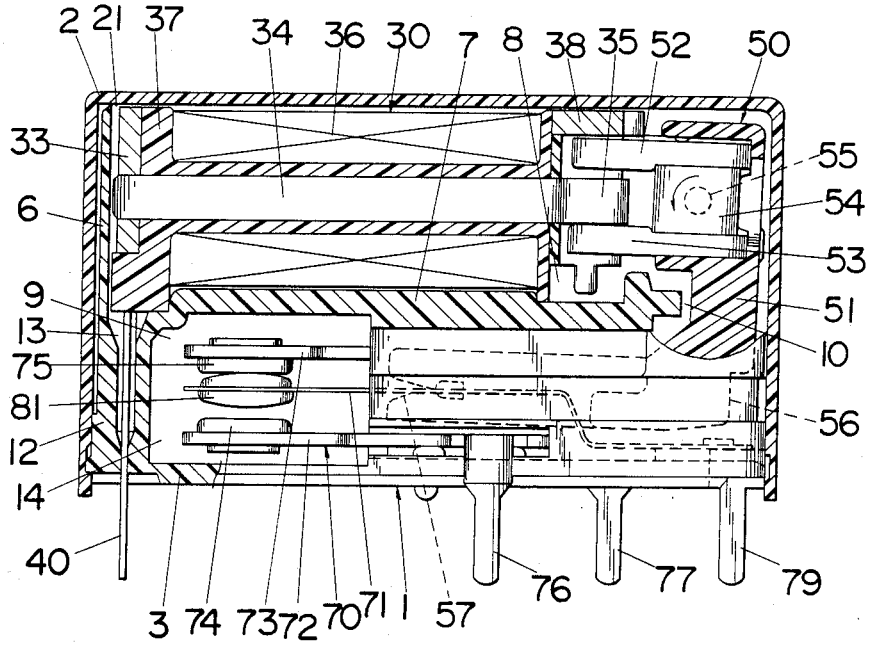
FIG. 3 is a longitudinal section, partly in front elevation, of the above relay.
Figure 4:
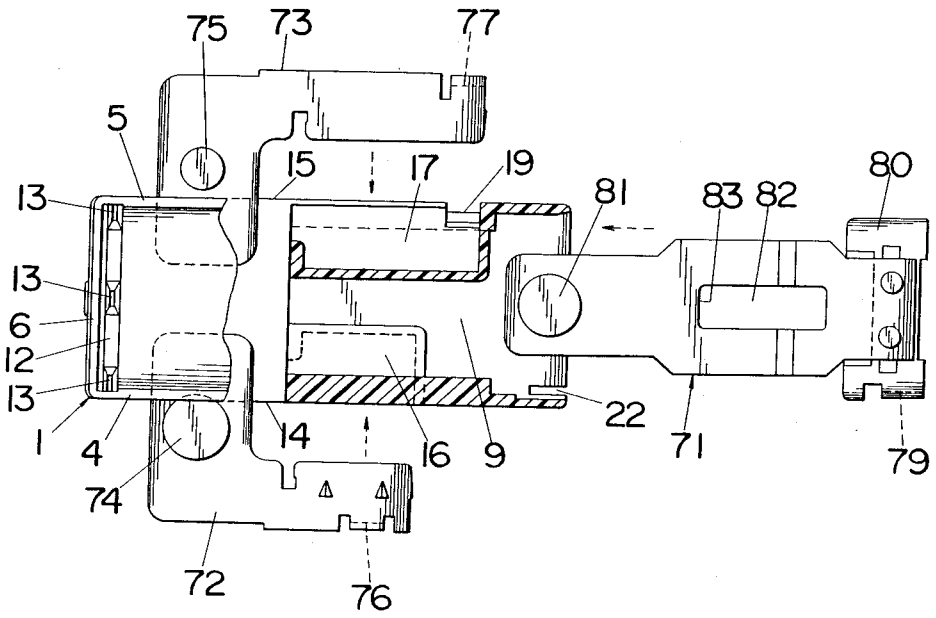
FIG. 4 is an exploded top view illustrating how a contact assembly is incorporated into the above relay.
Figure 5:
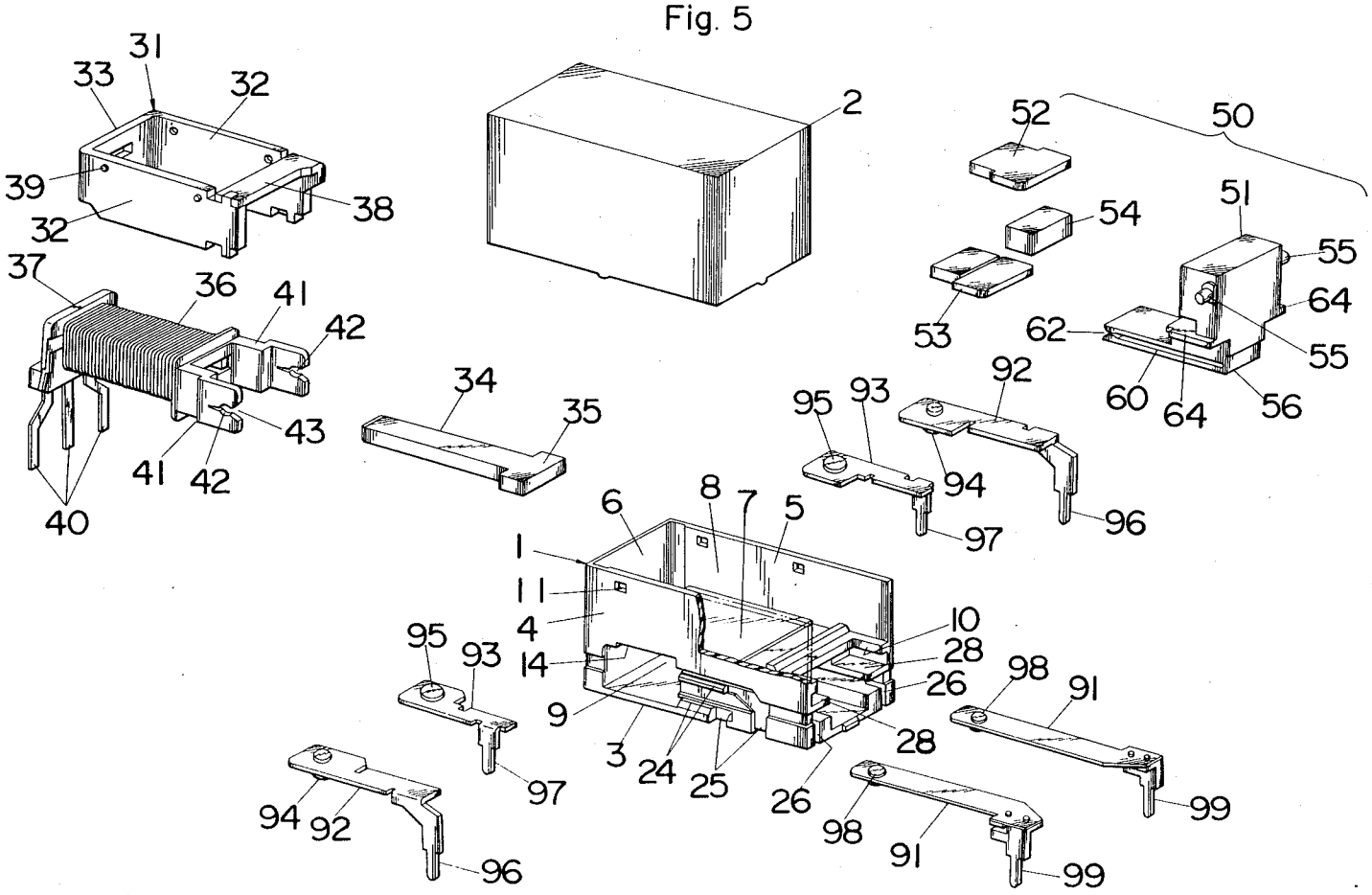
FIG. 5 is an exploded perspective view of an electromagnetic relay in accordance with a second embodiment of the present invention.

Said electromagnet 30 comprises a U-shaped yoke 31 having a pair of parallel legs 32 connected by a web 33, a core 34 extending from the web 33 in parallel relation to the yoke legs 32, and a winding 36 wound around the core 34 to magnetize the free ends of the yoke legs 32 to the opposite polarity to that of the core 34. The winding 36 is carried around a coil bobbin 37 molded from electrically insulative plastic material which is embraced between the yoke legs 32 and is supported thereto by means of said core 34 being inserted through the coil bobbin 37 to be connected to the web 33 of the yoke 31. One of the yoke legs 32 is provided at its free end with a bridge member 38 which extends integrally from upper end thereof. The bridge member 38 is bent at a right angle toward the other yoke leg 32 and is then clamped thereto by any known technique for rigid connection between the free ends of the yoke legs 32, reinforcing the yoke 31 to have good dimension stability against possible shocks which may be applied thereto at the time of assembling the relay. The bridge member 38 is thus spaced upwardly from an enlarged flat pole end 35 of the core 34 and serves as a pole member of the same polarity as the yoke legs 32 but of opposite polarity to the pole end 35. The electromagnet 30 thus constructed is fixed in place within said coil space 8 with protrusions 39 formed on the yoke legs 32 being snapped in complementary eyelets 11 formed in the upper end portion of the side walls 4 and 5 of the casing 1. A plurality of coil terminal lugs 40 provided at one longitudinal end of said coil bobbin 37 extend downwardly through individual vertical slots 13 formed in an upstanding section 12 at the juncture of the end wall 6 with the partition 7 to project outwardly of the bottom wall 3 of the casing 1, as best shown in FIGS. 3 and 4, for connection with an external relay control circuit. Extending horizontally from the other longitudinal end of the coil bobbin 37 are a pair of support arms 41 for pivotally supporting the armature 50. For this purpose, each support arm 41 has in its free end a bearing hole 42 with an open slit 43.

Said armature 50 includes a mold block 51 of electrically insulative plastic material which holds a pair of pole plates 52 and 53 and a permanent magnet 54. The pole plates 52 and 53 have their rear end portions embedded in the mold block 51 with the permanent magnet 54 interposed therebetween so as to be magnetized to opposite polarity. Projecting transversely from either side of the mold block 51 is a pivot pin 55 which is snapped into each of said bearing holes 42 through said open slit 43 so that the armature 50 is held by said support arms 41 for pivotal movement about a horizontal axis perpendicular to the longitudinal axis of the electromagnet 30.

As best shown in FIG. 3, the armature 50 has its major portion received within said coil space 8 adjacent the longitudinal end of the electromagnet 30 and is coupled thereto in such a way that said pole end 35 of the core 34 extends between the pole plates 52 and 53 and at the same time that the upper pole plate 52 extends between the pole end 35 and the bridge member 38. With this coupling, the armature 50 is driven to rotate in a direction indicated by an arrow in the figure to an operative position where the upper pole plate 52 is attracted to the pole end 35 of the core 34 when the electromagnet 30 is energized by a given polarity of voltage. When the electromagnet 30 is deenergized the armature 50 responds to rotate in the opposite direction into a stable position of FIG. 3 where the upper pole plate 52 is attracted to the bridge member 38 as the lower pole plate 53 to the pole end 35 of the core 34 for completing the magnetic circuit of the permanent magnet 54 and is retained at this stable position until the electromagnet 30 is again energized by the given polarity of voltage. In this sense, the relay of this embodiment is a polarized relay having a monostable armature operation.

Integrally formed with the mold block 51 of the armature 50 is a generally L-shaped card 56 which passes around the open end of said partition 7 or through said recess 10 to extend into the switching space 9 for connection of the armature 50 with the contact assembly 70. The card 56 is formed at the free end of its horizontal segment with a catch slit 57 for coupling with a movable contact spring 71 of the contact assembly 70.

The contact assembly 70 comprises the movable contact spring 71 and a pair of fixed contact plates 72 and 73 both being of generally L-shaped but having different lengths. Each of the fixed contact plates 72 and 73 carries at its one end each one of contact tips 74 and 75 and is formed at the other end with each one of downwardly extending terminal lugs 76 and 77. Said fixed contact plates 72 and 73 can be fixed to the casing 1 from the exterior thereof in a manner shown in FIG. 4. That is, the fixed contact plates 72 and 73 have their contact tip carrying portions inserted into the switching space 9 through respective ports 14 and 15 formed in the side walls 4 and 5 so as to locate the contact tips 74 and 75 in vertically spaced relation within the switching space 9, and are held in place by their side leg portions being press-fitted into longitudinal grooves 16 and 17 formed in the outer surfaces of the side walls 4 and 5. The ports 14 and 15 are formed at portion below said partition 7 and adjacent to said end wall 6 such that the contact tips 74 and 75 or switching contact portion of the contact assembly 70 is disposed deep inside of the switching space 9 so as to be apart a maximum distance from said recess 10 leading to the coil space 8 where the electromagnet 30 is mounted, thus substantially insulating the electromagnet 30 from the switching contact portion by the partition 7, end wall 6 and the side walls 4 and 5. Said terminal lugs 76 and 77 of the fixed contact plates 74 and 75 are fitted respectively in vertical grooves 18 and 19 continuous with the longitudinal ends of said lengthwise grooves 16 and 17 opposite to the ports 14 and 15 so that they extend downwardly and outwardly of the bottom wall 3.

Said movable contact spring 71 is in the form of an elongate blade having its one end portion connected to a contact base 80 with a terminal lug 79 and having on the upper and lower sides of the other end portion contact tips 81 which are engageable with the respective one of the contact tips 74 and 75 of said fixed contact plates 72 and 73. The movable contact spring 71 can be also fixed to the casing from the exterior thereof in a manner shown in FIG. 4. The movable contact spring 71 is introduced through the open end of the casing 1 into said switching space 9 and is secured to the casing 1 by inserting the lateral edges of said contact base 80 in a press-fitted manner into end slits 20 formed in the inner surface of the side walls 4 and 5 adjacent the bottom wall 3 with the terminal lug 79 extending outwardly through a notch 22 in the bottom wall 3 of the casing 1. Formed in the middle portion of the movable contact spring 71 is an aperture 82 which has its edge 83 inserted into said catch slit 57 at the free end of the card 56 for connection therewith. Thus, the movable contact spring 71 is operatively connected to the armature 50 and is movable therewith in response to the energization and deenergization of the electromagnet 30. Said switching contact portion including the contact tip 81 of the movable contact spring 71 is accessible through either port 14 or 15 from the exterior of the casing 1 and therefore can be adjusted its contact gap by the use of a suitable adjusting tool insertable through the port 14 or 15. The ports 14 and 15 are closed by the shield cover 2 fitted over the casing 1.

Figure 9:
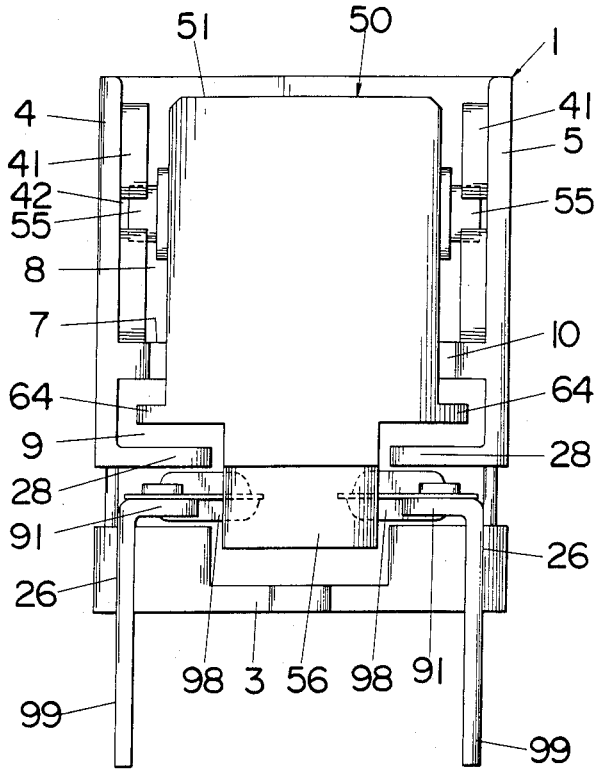
FIG. 9 is a side view of the above relay.
Figure 10:
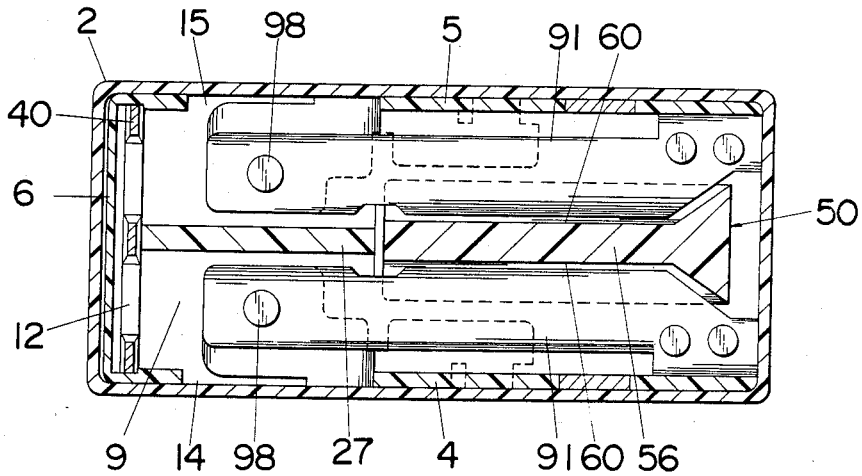
FIG. 10 is a horizontal section of the above relay.

Referring to FIGS. 5 to 10, there is shown an electromagnetic relay in accordance with a second embodiment of the present invention which is similar in construction to the first embodiment except for a contact assembly 90 and for the detailed configuration of the armature 50. The like numerals are employed to designate like parts. In this embodiment, the contact assembly 90 includes two sets of contact units each comprising a movable contact spring 91 and a pair of fixed contact plate 92 and 93. The fixed contact plates 92 and 93 of each contact unit are introduced into the switching space 9 of the casing 1 by inserting the carrier portion for contact tips 94 and 95 through each of the ports 14 and 15 in the side walls 4 and 5 and are fixed to the casing 1 by their side legs press-fitted into longitudinal grooves 24 in the outer surface of each of the side walls 14 and 15. Likewise in the first embodiment, terminal lugs 96 and 97 integral with the fixed contact plates 92 and 93 of each contact unit are received in vertical grooves 25 continuous with the longitudinal grooves 24 so as to extend downwardly of the bottom wall 3. The contact tips 94 and 95 of the fixed contact plates 92 and 93 of each contact unit are vertically aligned with a contact tip 98 of each movable contact spring 91 interposed therebetween, these contact tips defining switching contact portion of each contact unit. The two sets of contact units thus constructed and received in the switching space 9 are transversely spaced and have their switching contact portions separated from each other by a separator 27 depending from said partition 7 and continuous with the end wall 3, as shown in FIG. 10.

Each of the movable contact spring 91 is in the form of elongate blade having a terminal lug 99 at its one end and having on the upper and lower sides of the other end said contact tips 98 which are engageable with the respective one of the contact tips 94 and 95 of the fixed contact plate 92 and 93. Each movable contact spring 91 extends longitudinally within the switching space 9 and is fixed to the casing 1 by inserting the upper end of the terminal lug 99 in a press-fit manner into a vertical slit 26 formed in the open end side of the bottom wall 3 adjacent each of the side walls 4 and 5.

Figure 7:
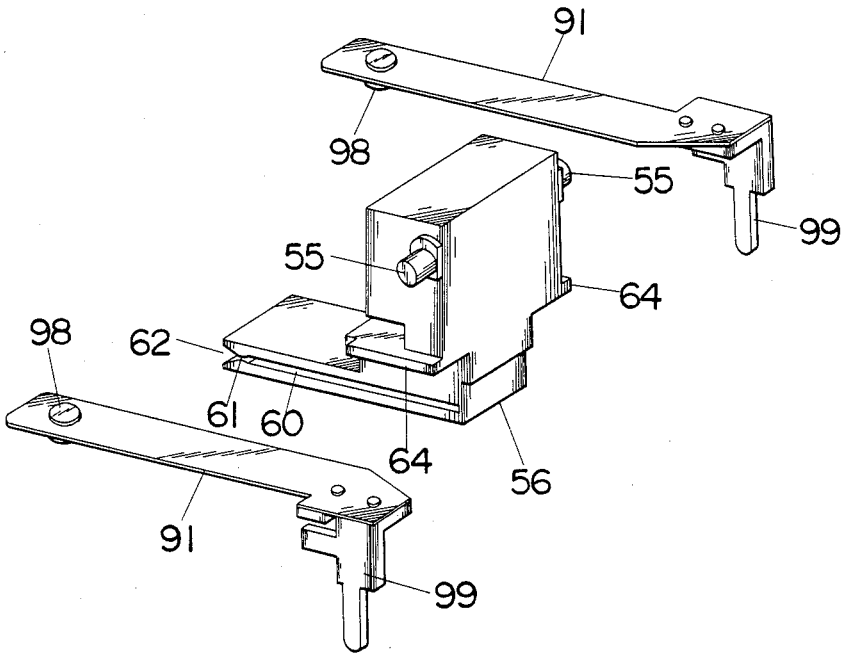
FIG. 7 is an exploded perspective view of an armature employed in the above relay.
Figure 8:
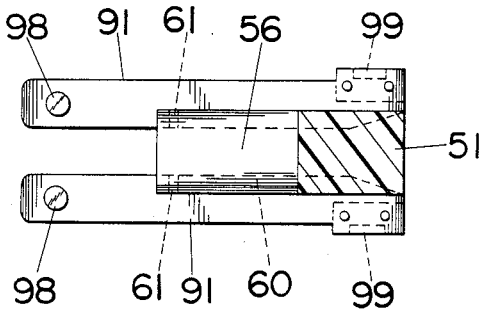
FIG. 8 is a top view, partly in section, of the armature.

As best shown in FIG. 7, the armature 50 of this embodiment is further formed in each of the lateral sides of the horizontally extending section of the card 56 with a furrow 60 into which the side edge of the rear half portion of each movable contact spring 91 is loosely fitted. The furrow 60 is formed at a portion near the free end of the card 56 with a wedge portion 61 at which portion said movable contact spring 91 is clamped to the card 56 for transmitting the force therethrough from the armature 50 to the movable contact spring 91. A V-shaped catch opening 62 is formed at the extremity of each furrow 60 for easily catching the edge portion of the movable contact spring 91 at the time of inserting the horizontal section of the card 56 into the switching space 9 for connection with the movable contact springs 91. In this respect, the movable contact springs 91 act as a horizontal guide for easy insertion of the card 56 into the switching space 9 of the casing 1. It is noted at this point that said pivot pins 35 of the armature 50 can be snapped through the open slit 43 into the bearing holes 42 of the electromagnet 30 at the time of inserting the card 56. Thus, the armature 50 can be easily combined with the electromagnet 30 and the contact assembly 90 simply by inserting it into the casing 1.

Figure 6:
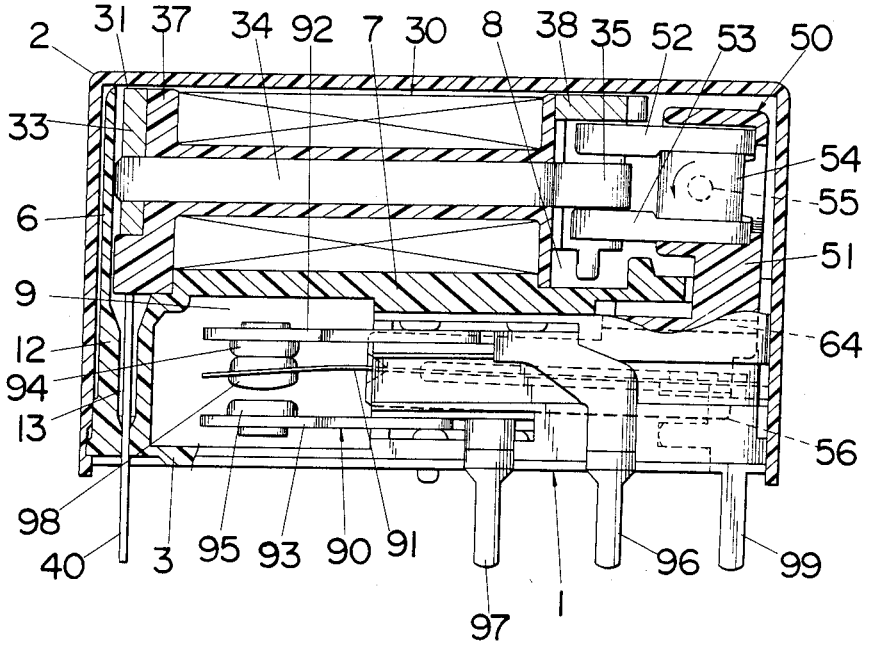
FIG. 6 is a longitudinal section, partly in front elevation, of the relay of FIG. 5.

The coupling between the armature 50 and the contact assembly 90 is such that, when the armature 50 is brought into its stable position of FIG. 6 in response to deenergization of the electromagnet 30, the movable contact spring 91 of each contact unit is kept into contacting engagement with the upper fixed contact plate 92 and out of contacting engagement with the lower fixed contact plate 93. When the armature 50 rotates in a direction indicated by an arrow of the same figure in response to energization of the electromagnet 30, the movable contact spring 91 is urged by the card 56 into contacting engagement with the lower fixed contact plate 93 and out of contacting engagement with the upper fixed contact plate 92.

Said armature 50 is further formed on both sides of the mold block 51 with integral skirts 64 which are located below said recess 10 at the open end of the partition 7 and extend toward the side walls 4 and 5 of the casing 1 with its front portion kept in close relation to the end of the partition 7, as shown in FIGS. 6 and 9. A pair of flaps 28 are integrally formed with the side walls 4 and 5 at portions just above the rear ends of the movable contact springs 91 but below said recess 10. Each flaps 28 extends inwardly toward the underside of each skirt 64 in such a manner as to be in overlapping relation therewith, thus leaving between the armature 50 and the side walls 4 and 5 only a zig-zag paths which serve to considerably elongate the communication path extending through said recess 10 between the switching space 9 and the coil space 8. With this result, a possible arcing or the like flashover is prevented from running through said recess 10 from the contact assembly 90 to the electromagnet 30 or the electrically conductive portion of the armature 50. Consequently, the recess 10 is substantially closed by the combination skirts 64 and the flaps 28 so that the coil space 8 can be insulatively separated from the switching space also at the open end of the casing 1.

Figure 11:
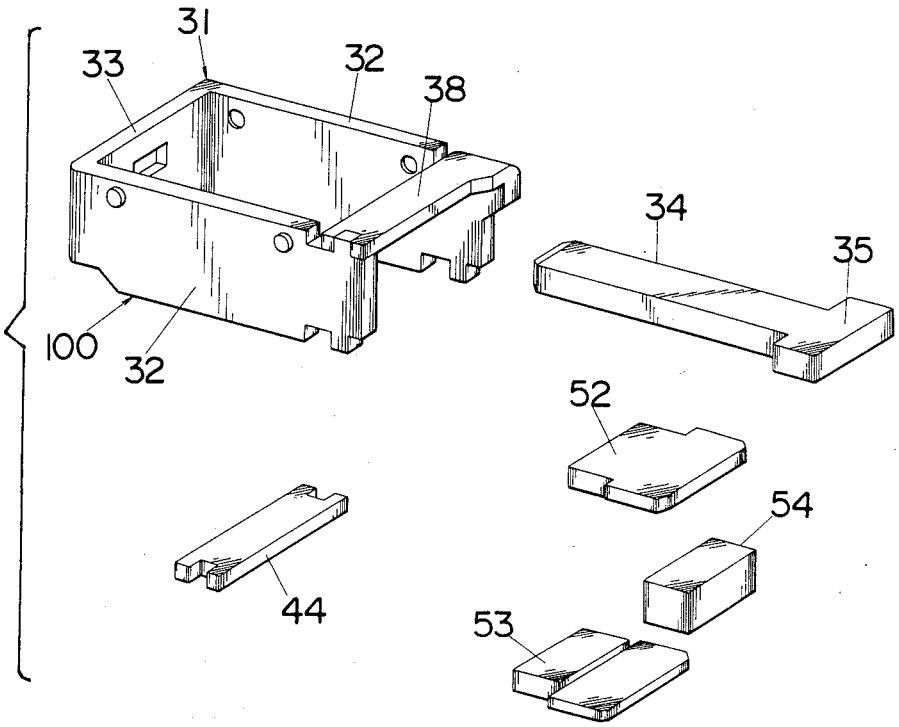
FIG. 11 is an exploded perspective view of an electromagnet employed in an electromagnetic relay of a third embodiment.
Figure 12:
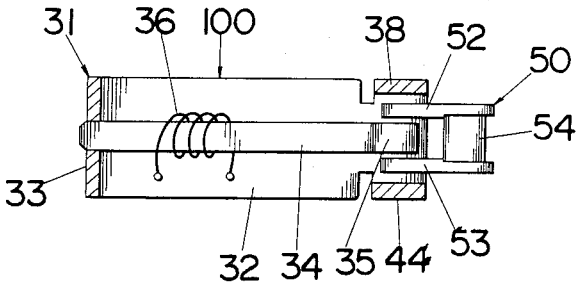
FIG. 12 is a schematic illustration of the electromagnet of FIG. 11.

Referring to FIG. 11, an electromagnet 100 employed in a relay in accordance with a third embodiment of the present invention. The electromagnet 100 is identical in construction to that of the previous embodiment except that another lower bridge member 44 is added to extend over the free ends of the yoke legs 32 in vertically spaced relation to the upper bridge member 38. The like numerals are employed to designate like parts as in the previous embodiments. The other constructions of the relay of this embodiment is identical to those of the second embodiment. The added lower bridge member 44 is also made of magnetic material serving as a pole member of the same polarity as the upper bridge member 38 and of opposite polarity to the pole end 35 of the core 34. These bridge members 38 and 44 are equally vertically spaced from the pole end 35 interposed therebetween. As shown in FIG. 12, the electromagnet 100 thus constructed is magnetically coupled to the armature 50 of like construction (although only the permanent magnet 54 and the pole plates 52 and 53 thereof are illustrated in the figures) in such a manner that each of the pole plates 52 and 53 extends between the pole end 35 and each of the upper and lower bridge members 38 and 44. With this arrangement, the armature 50, in response to the electromagnet 100 being energized by the voltage of opposite polarity, is driven to rotate into opposite positions at each of which the one of the pole plates 52 and 53 is attracted to the pole end 35 of the core 34 and at the same time the other pole plate is attracted to each of the bridge members 38 and 44. Upon deenergization of the electromagnet 100, the armature 50 is kept at each of the above positions as the magnetic circuit of the permanent magnet 54 is completed through the pole plates 52 and 53, core 34, yoke legs 32 and 33, and through each of the bridge members 38 and 44. Consequently, the armature 50 can have the two stable positions, whereby giving a bistable switching characteristic to the contact assembly (not shown) to be connected to the armature 50 in the same manner as in the second embodiment.

Said lower bridge member 44 may be a separate piece to be clamped at its both ends to the free ends of the yoke legs 32 or may be a continuous piece which extends integrally from one of the yoke legs 32 and which is to be bent toward the other yoke leg and is then clamped thereto.

What is claimed is:

1. An electromagnetic relay comprising:

a casing of electrically insulative material having a bottom wall having lateral sides, opposed side walls having longitudinal ends, said side walls extending upwardly from the lateral sides thereof, an end wall extending upwardly from one of said longitudinal ends of the bottom wall and joining said side walls at its lateral ends;

an insulation partition extending from said end wall in generally parallel relation to the bottom wall between the opposed side walls so as to define a coil space thereabove and a switching space therebelow;

said bottom wall, side walls, end wall and insulation partition being integrally formed of insulative material;

an electromagnet having a length defined by two longitudinal ends, said electromagnet being received within said coil space and having a winding with a longitudinal axis extending horizontally along said partition;

a contact assembly received within said switching space with its switching contact portion located in close proximity to said end wall and including at least one movable contact;

an armature which is disposed adjacent the longitudinal end of the electromagnet remote from said end wall to be magnetically coupled thereto and which is operatively connected to said contact assembly for switching operation thereof in response to the energization of the electromagnet;

said partition extending along the entire length of the electromagnet without leaving any communication path between the coil space and the switching space so as to completely separate the coil space from the switching space along the length of the electromagnet;

said partition terminating at an edge, which edge is recessed with respect to the longitudinal ends of the side walls remote from the end wall to define thereat a recess through which the coil space and the switching space are intercommunicated; and said armature having a card of electrically insulative material which extends through said recess into the switching space where it is connected to the movable contact of the contact assembly.

2. An electromagnetic relay as set forth in claim 1, wherein said electromagnet comprises a U-shaped yoke having a pair of opposed legs connected by a web at one end of said legs, the other end of said legs being a free end, a core extending from said web in parallel relation with the legs of the yoke, a winding wound around the core, and a bridge member which extends across the free ends of the legs for rigid connection therebetween.

3. An electromagnetic relay as set forth in claim 1, wherein said electromagnet comprises a U-shaped yoke having a pair of opposed legs connected by a web at one end of said legs, the other end of said legs being free ends, a core extending from said web in parallel relation with the legs of the yoke, said core having a free end, a winding wound around the core, and a bridge member which rigidly connects the free ends of the legs and serves as a pole member of opposite polarity to the core, said bridge member being spaced from the free end of the core in a direction perpendicular to the plane of the legs of the yoke, and wherein said armature includes a pair of pole plates spaced along a direction perpendicular to the plane of the legs of the yoke and magnetically polarized to the opposite polarity by a permanent magnet interposed therebetween, said armature being magnetically coupled to said electromagnet with one of the pole plates extending between the core and the bridge member such that it has a stable position where the one pole plate is attracted to the bridge member upon deenergization of the electromagnet.

4. An electromagnetic relay as set forth in claim 1, wherein said electromagnet comprises a U-shaped yoke having a pair of opposed legs connected by a web, a core extending from said web in parallel relation with the legs of the yoke, a winding wound around the core, and a pair of bridge members extending across the free ends of the legs of the yoke for rigid connection therebetween, said bridge members being of magnetic material to serve as respective pole members of opposite polarity to the core and spaced from each other in a direction perpendicular to the plane of the legs with the free end of the core interposed therebetween; and wherein said armature includes a pair of pole plates spaced in a direction perpendicular to the plane of the legs of the yoke and magnetically polarized to the opposite polarity by a permanent magnet interposed therebetween, said armature being magnetically coupled to the electromagnet with each of the pole plates extending between each of the bridge members and the core such that it has a two stable positions where each of pole plate is attracted to the adjacent bridge member upon deenergization of the electromagnet.

5. An electromagnetic relay as set forth in claim 1, wherein said contact assembly is received within the switching space with its electrically conductive portion located below said recess, said armature being formed on its lateral sides with skirts of electrically insulative material extending toward the side walls; said side walls being formed at portions adjacent the recess with inwardly extending flaps each being arranged in overlapping relation to each of said skirts in such a way as to substantially close said recess for insulation of the electromagnet from the electrically conductive portion of the contact assembly.

6. An electromagnetic relay as set forth in claim 1, wherein at least one of said side walls is formed at a portion below said partition with a port through which the switching contact portion of the contact assembly is accessible from the exterior of the casing.

7. An electromagnetic relay as set forth in claim 1, wherein said contact assembly includes two sets of contact units each comprising the movable contact and at least one fixed contact engageable therewith, and wherein said partition is formed with a separator which depends therefrom so as to divide said switching space into separate compartments each receiving therein each of the contact units.

* * * * *